United States Patent [19]

Morrison et al.

[11] 4,079,576

[45] Mar. 21, 1978

[54] IN-LINE INSERTER

[75] Inventors: Wilbur J. Morrison; Norwood E. Tress, both of Bath, Pa.

[73] Assignee: Bell & Howell Company, Phillipsburg, N.J.

[21] Appl. No.: 569,989

[22] Filed: Apr. 21, 1975

[51] Int. Cl.[2] ..... B65B 5/04

[52] U.S. Cl. ..... 53/266 A

[58] Field of Search ..... 53/266 A, 206, 386, 53/188, 259, 258, 187, 189, 210; 271/14, 100, 102, 11, 99, 233, 269; 270/58

[56] References Cited

U.S. PATENT DOCUMENTS

| | | | |
|---|---|---|---|
| 2,082,064 | 6/1937 | Kleineberg | 271/100 |
| 2,736,999 | 3/1956 | Rouan et al. | 53/266 A X |
| 2,746,221 | 5/1956 | Rouan et al. | 53/266 A X |
| 3,155,386 | 11/1964 | Burleigh | 271/100 X |
| 3,217,464 | 11/1965 | Feingold | 53/259 X |
| 3,248,849 | 5/1966 | Hanson | 53/210 |
| 3,423,900 | 1/1969 | Orsinger | 53/266 A X |
| 3,491,514 | 1/1970 | Burford | 53/386 X |
| 3,825,247 | 7/1974 | Fernandez-Rana et al. | 270/58 |

*Primary Examiner*—Othell M. Simpson
*Assistant Examiner*—Horace M. Culver
*Attorney, Agent, or Firm*—Griffin, Branigan & Butler

[57] ABSTRACT

An in-line inserter device comprises envelope and insert feeding assemblies, a stuffing-station assembly and a sealing and stacking assembly. The envelope feeding assembly withdraws envelopes from a hopper-held envelope stack and conveys them along an involute path toward the stuffing station. The insert feeding assembly comprises a plurality of hopper-held insert stacks which are positioned in line with an insert conveyor. The insert conveyor carries dispensed inserts from the hopper-held insert stacks to the stuffing station. The stuffing station assembly coordinates operation of the insert and envelope feeding assemblies in a special way to efficiently accomplish the stuffing of the inserts into the envelopes. Subsequent to such stuffing, filled envelopes are conveyed from the stuffing station, sealed, and stacked by the sealing and stacking assembly.

8 Claims, 13 Drawing Figures

FIG. 3
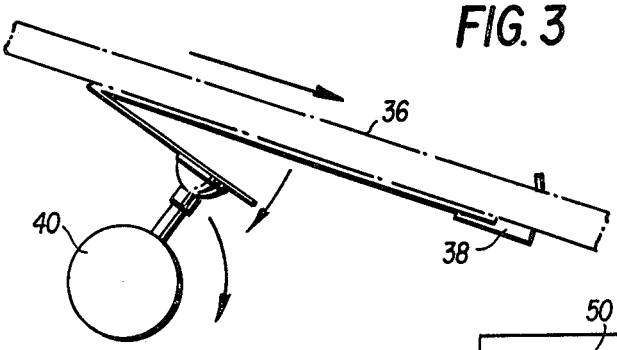
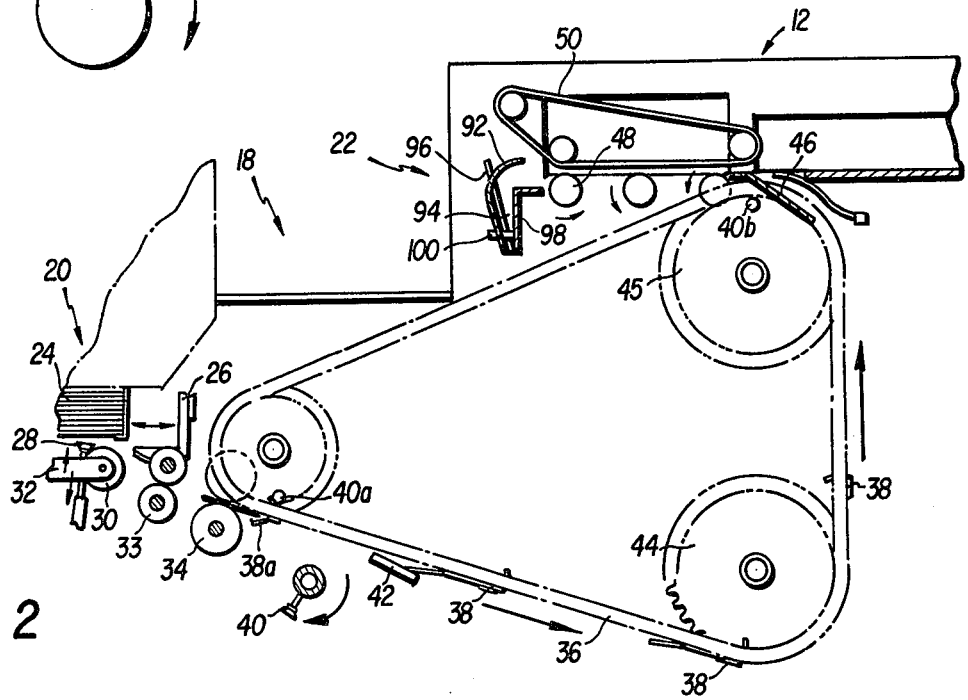
FIG. 2
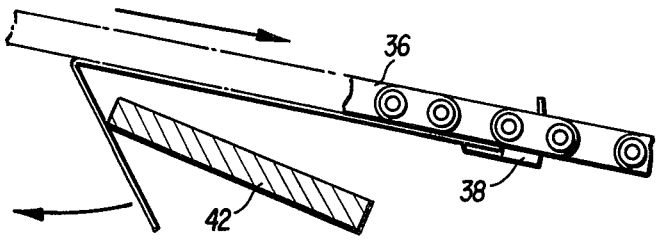
FIG. 4

IN-LINE INSERTER

BACKGROUND OF THE INVENTION

This invention relates to apparatus for handling business mail and, in particular, it relates to in-line inserter devices.

Many present mechanical devices for stuffing inserts into envelopes employ conveyors for conveying envelopes along a path while reciprocating jaws, moving laterally to the envelope path, stuff inserts into the envelopes. In many cases, the envelopes are stopped at each stuffing station and a respective jaw thereat is activated. These types of inserter devices are rather jerky and vibrational in operation, so that undue wear is caused thereto over long periods of time and their accuracy is thereby impaired.

Thus, it is an object of this invention to provide an inserting device which is not unduly jerky in operation, but which provides smooth and continuous types of motion.

It is a further object of this invention to provide such an inserter assembly which is compact in size, but yet is efficient in operation.

A difficulty that has been encountered in some prior art in-line sheet feeders is that when in-line sheet hoppers thereof are operated simultaneously, a significantly high-power requirement to drive all the hoppers together is brought about. Thus, it is yet another object of this invention to provide an in-line sheet feeding apparatus which does not have an unduly large power requirement to drive hoppers.

SUMMARY

In accordance with principles of an aspect of this invention, envelopes are conveyed from a hopper to a stuffing station and from the stuffing station to a licking and stacking system along an involute path. The envelopes are conveyed from the hopper to the stuffing station by means of an endless, continuously-running, conveyor. The envelopes are stopped at the stuffing station and are opened to be stuffed with inserts. The inserts are furnished by a plurality of insert hoppers which are positioned in a line above an endless insert conveyor. The endless insert conveyor has pusher pins mounted thereon for engaging the inserts to drive them along the conveyor. The hoppers are positioned significantly further apart than the conveyor pusher pins. The odd hoppers dispense inserts simultaneously and the remaining hoppers dispense inserts 180° out of phase with these hoppers.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis being placed instead on illustrating principles in a clear manner.

FIG. 2 is a sectional view of apparatus associated with an envelope path of travel in the apparatus of FIG. 1, with some elements thereof being depicted schematically;

FIG. 3 is an enlarged view of a rotating sucker foot of the FIG. 2 apparatus;

FIG. 4 is an enlarged view illustrating the operation of a rake of the FIG. 2 apparatus;

DESCRIPTION OF THE PREFERRED EMBODIMENT

Figure 1:
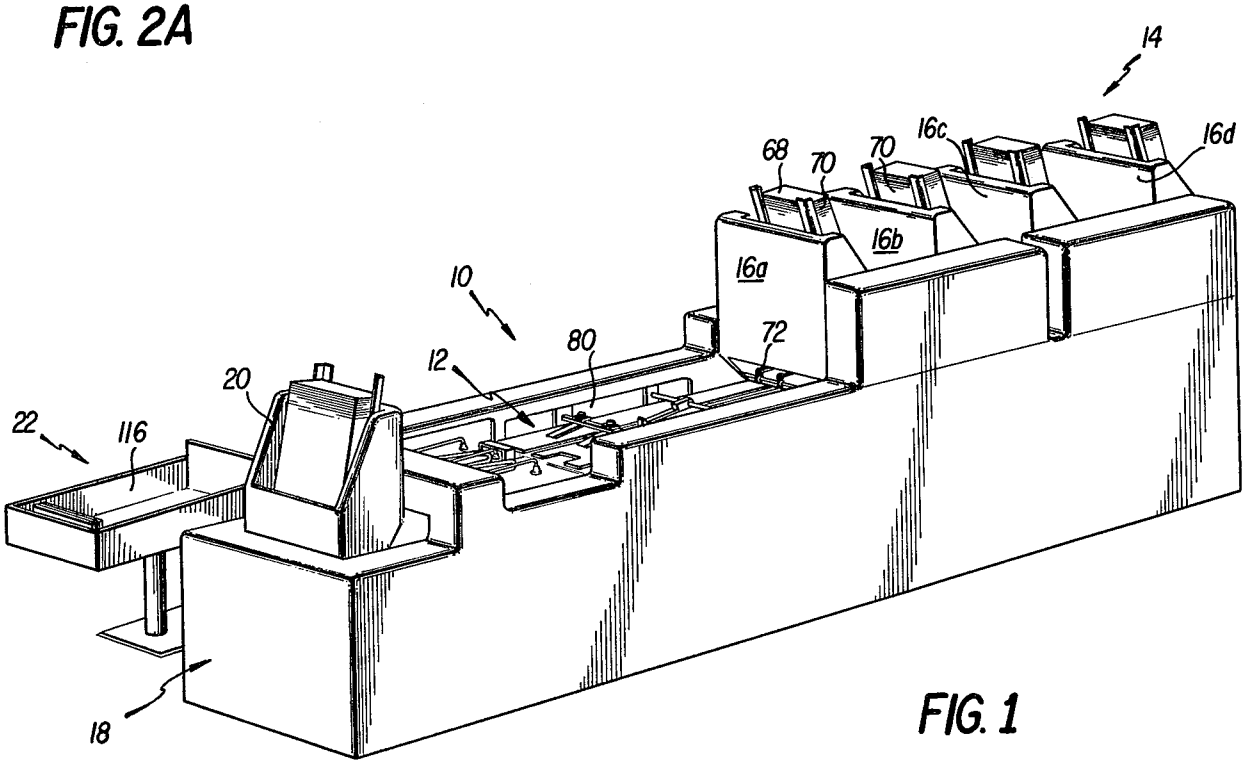
FIG. 1 is an isometric view of an in-line inserter according to the invention.

Referring to the elements of the invention as embodied in the drawings, an overall in-line inserter assembly 10 (FIG. 1) basically comprising four independently operating, but cooperating subsystems as follows: a stuffing station 12, with associated structure; an insert system 14 for furnishing inserts from insert hoppers 16*a–d* and conveying them toward the stuffing station 12; an envelope system 18 for furnishing envelopes from an envelope hopper 20 and conveying them toward the stuffing station 12 at which the envelopes are mated with the inserts; and a sealing and stacking system 22 which handles stuffed envelopes.

Describing first the envelope system 18, with reference to FIG. 2, bottom-most envelopes in a hopper-held stack 24 are withdrawn, one at a time, by a pull-foot feeding device 26 in the manner described in a commonly assigned application of Winston A. Orsinger and Norwood E. Tress for a Pull-Foot Sheet Feeding Device, filed simultaneously with this application. As described in the "Pull-Foot" application specification, a bottom-most envelope is bent away from the hopper-held stack 24 by a reciprocating suction cup 28. The pull-foot feeding device 26 is then cammed to a position between the bottom-most envelope and the hopper-held stack 24. A bottom roller 30 is also cammed upwardly on an arm 32 to pinch the bottom-most envelope between the heel of the pull-foot feeding device 26 and the bottom roller 30. The pull-foot feeding device 26 is then cammed outwardly, away from the hopper-held stack 24, to the right in FIG. 2, pulling the bottom-most envelope with it until the bottom-most envelope is finally gripped by driven ejection rolls 33. The ejection rolls 33 feed the envelope to the faster-driven transfer rolls 34. Thus, the envelope's speed is gradually accelerated to that of a gripper-jaw transport chain 36. It might be noted that the ejection rolls 33 are one-way clutched so that their speed can be increased to follow that of an envelope as it is driven faster by the transfer rolls 34.

Gripper jaws 38 are mounted on the gripper-jaw transport chain 36 for gripping envelopes received from the transfer rolls 34 and delivering them to the stuffing station 12. The gripper-jaw chain 36 is driven in the direction indicated by arrows in FIG. 2 and its relative position is coordinated by a timing chain (not shown) with the position of the pull-foot feeding device 26 such that a gripper jaw 38*a* is in an appropriate position to receive an envelope fed by the pull-foot feeding device 26, as is depicted in FIG. 2. In this respect, the gripper jaws 38 are opened and closed at appropriate times for gripping and releasing envelopes by stationary, grip-and-release cams 40*a* and *b*.

Describing the journey of a single envelope from the transfer rolls 34 to the stuffer station 12, a gripper jaw 38 grasps the single envelope and draws it past a rotating sucker foot 40 which serves to initiate opening of the envelope's flap. The rotating-sucker-foot's operation is more clearly illustrated in FIG. 3. The position of the rotating sucker foot 40 and its suction is also controlled by the timing chain (not shown). As the envelope is drawn past the rotating sucker foot 40 the sucker foot 40 grips the envelope's flap for a predetermined period of time and then releases it. The rotational speed of the sucker foot 40 is related to that of the gripper jaw transport chain 36 such that the sucker foot partially opens the flap (FIG. 3).

As the envelope is moved further along the path of the gripper jaw transport chain 36, it is drawn past a stationary rake 42 which serves to fully open the envelope's flap. A closeup of this raking operation is illustrated in FIG. 4.

The gripper jaw transport chain 36 then conveys the envelope around a sprocket 44 and partially around a sprocket 45 to the insert stuffing station 12. Upon arriving at the stuffing station 12, the envelope rides up onto a stripping ramp 46 whereupon the cam 40*b* opens the gripper jaw 38 and the envelope is pinched between driven, envelope positioning rollers 48 and idler-type pressure belts 50 (See also FIG. 5). The envelope positioning rollers 48 extend slightly above the top surface of the stripping ramp 46 through slots 51 in the stripping ramp 46.

Figure 2A:
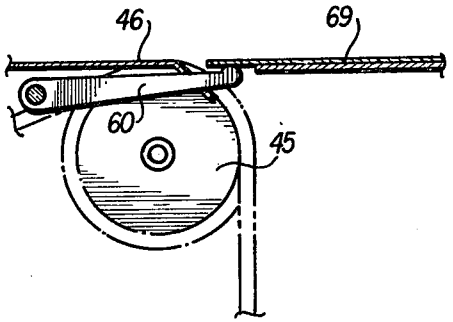
FIG. 2A is an enlarged view of a portion of the envelope path of travel of FIG. 2 showing the details of a flap holder.
Figure 5:
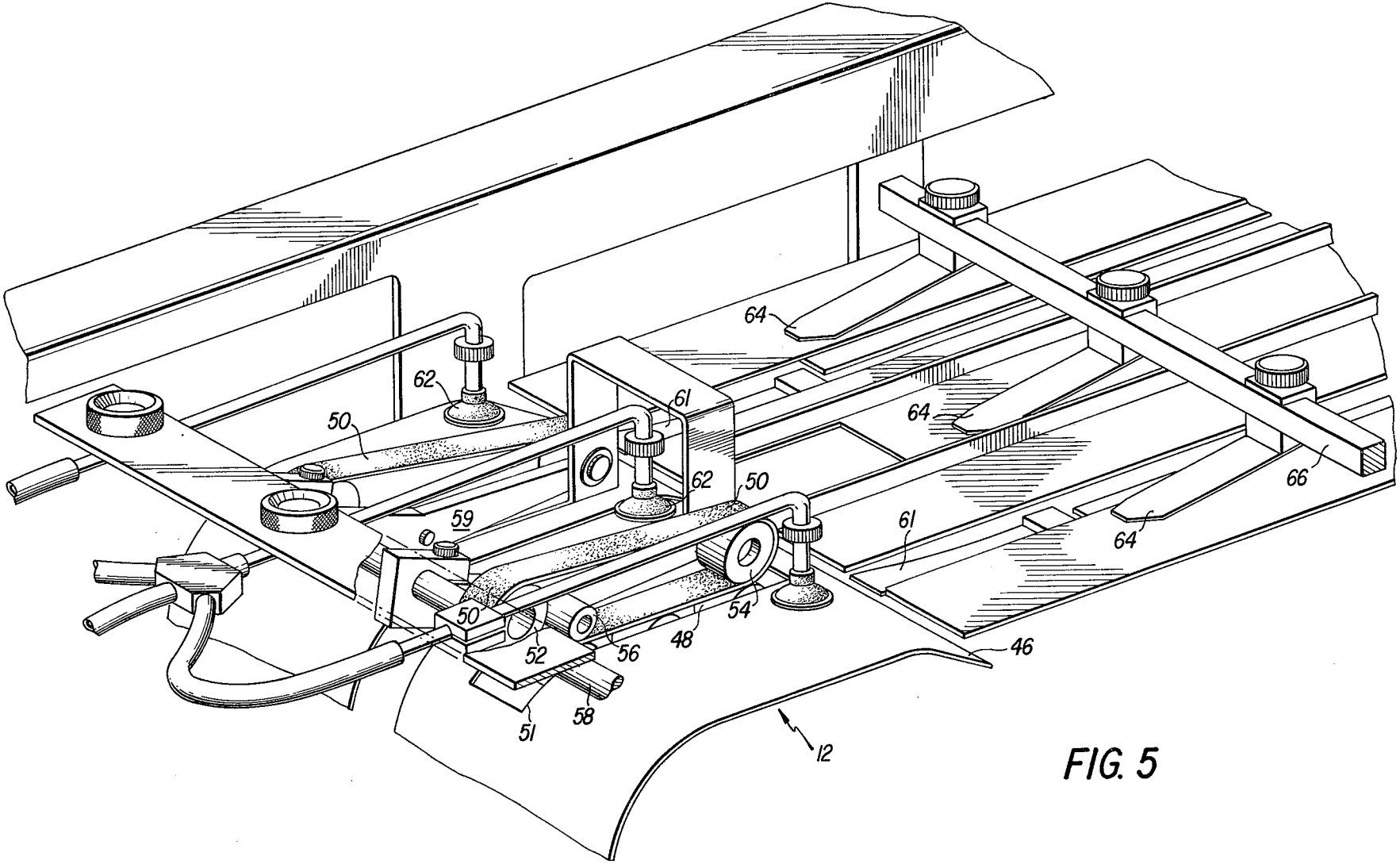
FIG. 5 is an isometric view of apparatus associated with a stuffing station of the inserter of FIG. 1.
Figure 6:
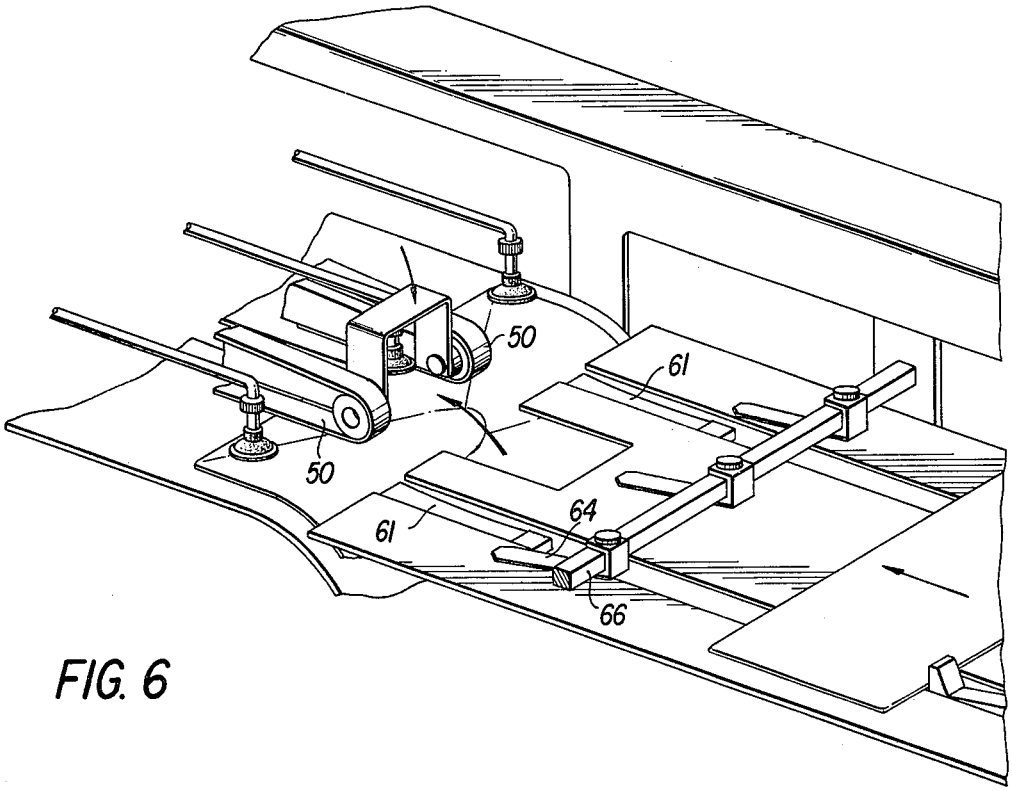
FIGS. 6 and 7 are additional isometric views of apparatus associated with the stuffing station at different points in time during its sequence of operation.
Figure 7:
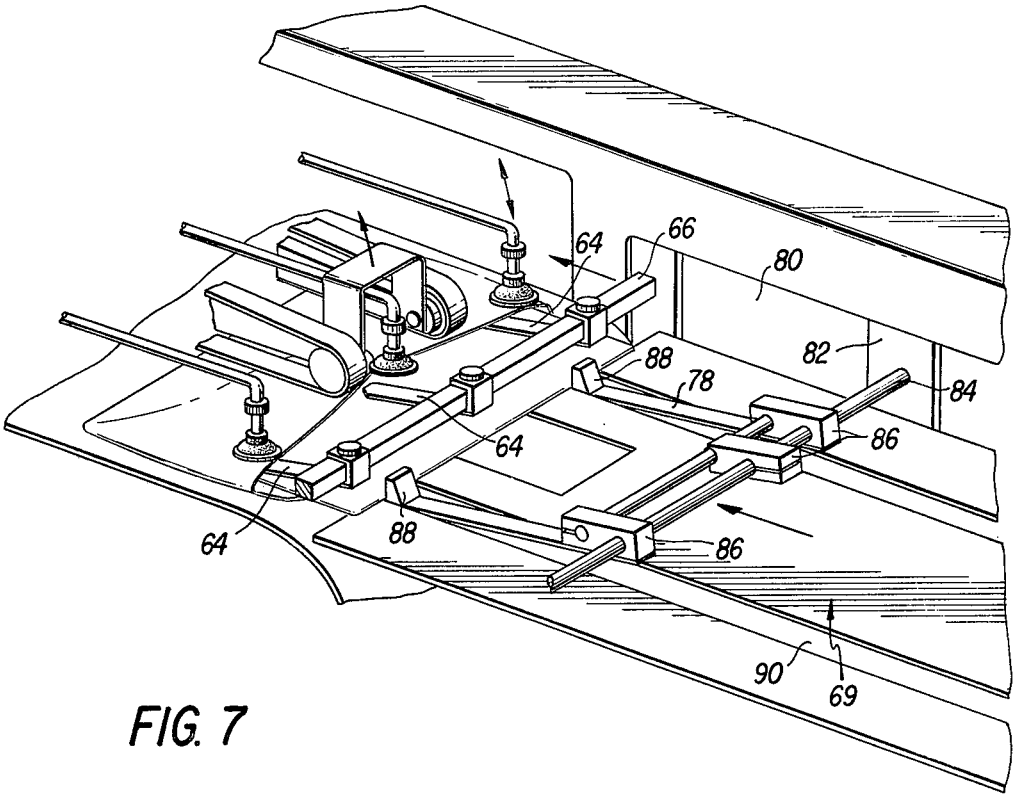

The idler-type pressure belts 50 ride on pulleys 52, 54, and 56. Supporting arms 59 are fixed to a controlling shaft 58 and the pulleys 52, 54 and 56 are rotatably mounted on the supporting arms 59. The pressure belts can thus be lowered into position, as shown in FIGS. 5 and 6, at the same moment that the gripper jaw 38 is opened to release an envelope. Thus the envelope positioning rollers 48 and the pressure belts 50 assume full control over the envelope as the gripper jaw 38 drops below the level of the stuffing station and proceeds on its return route to the envelope hopper 20. The driven, envelope positioning rollers 48 are programmed to stop rotating with the envelope held in a stuffing position, which is illustrated in FIG. 7. A flap holder 60, FIG. 2A, is then rotated upwardly to grip the envelope's flap between the flap holder 60 and an insert track 69 which will be described in more detail below. The envelope's main body is thusly held ready to be opened to receive inserts.

Sucker feet 62 are fixedly mounted on a separate controlling shaft (not shown) for rotation therewith. This separate controlling shaft rotates concurrently with the controlling shaft 58. After suction is applied to the sucker feet 62, so that they grip the top side of an envelope, the sucker feet 62 are rotated upwardly, at the same time that controlling shaft 58 lifts the pressure belts 50. Thus, the top side of the envelope in the stuffing position is pulled upwardly by the sucker feet so that the envelope is now opened. Boxing fingers 64, which are mounted on a lateral reciprocating shaft 66, are moved into such an open envelope to maintain it in this receiving, open position, as in FIG. 7.

Figure 8:
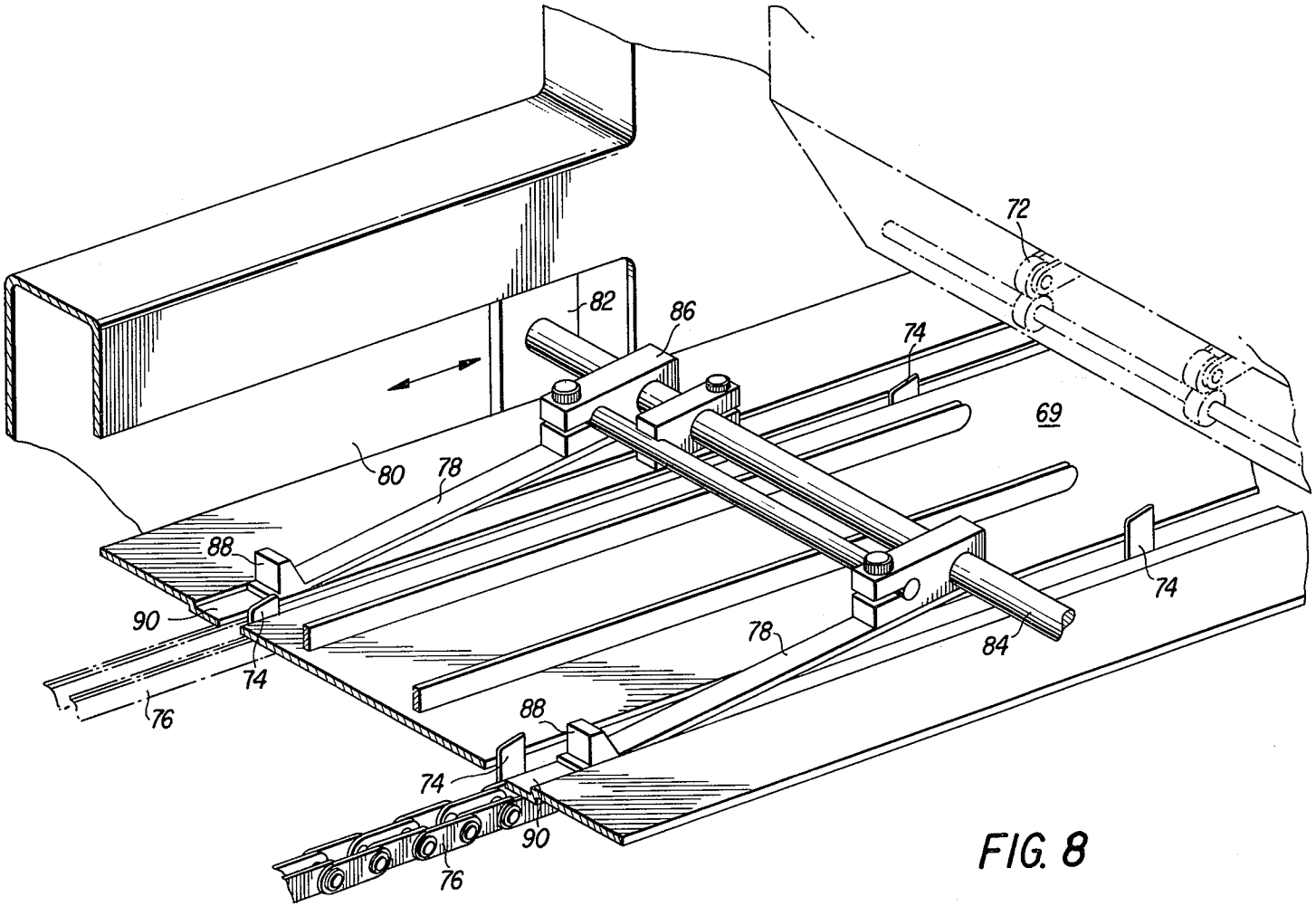
FIG. 8 is a partially cutaway isometric view of pusher arms and associated structures.
Figure 9:
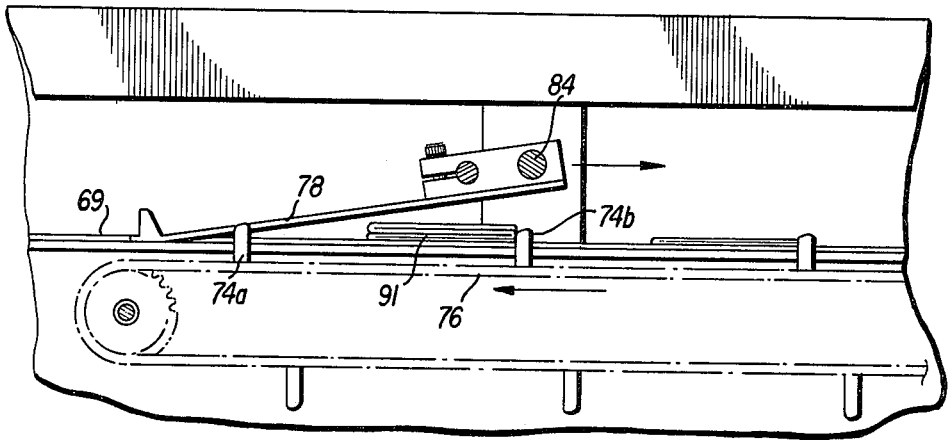
FIGS. 9–11 are sectional views depicting the pusher arms at various points in time during their operational sequence.

Turning next to the insert system, with reference to FIGS. 1 and 8, inserts are fed from insert hoppers 16*a–d* onto an insert track 69 (FIG. 8) by means of pull-foot feed mechanisms of the same type as the pull-foot device 26 described above with the envelope system 18. It is not thought necessary to describe this mechanism again here. An insert which is pulled away from one of hopper-held stacks 70 (FIG.1) is delivered by a set of transfer rolls 72 onto the insert track 69, which is situated below the insert hoppers 16*a–d*. The insert track (shown in FIG. 8) includes spaced sets of pusher pins 74 carried on continuously-moving constant speed conveyor chains 76. The conveyor chains 76 progress in the direction of the stuffing station 12 (FIG. 1), in the same direction in which the inserts are withdrawn from the hoppers 16*a–d*.

The hoppers 16*a–d* are arranged so that they are operated alternately in phase. Elaborating on this, hoppers 16*a* and *c* deposit their inserts onto the insert track at the same time, and hoppers 16*b* and *d* deposit their inserts at the same time, but 180° out of phase with hoppers 16*a* and *c*. This staggered phase relationship of the hoppers, which can be adjusted depending on the sizes of the inserts, is designed to smooth out the insert hopper's power requirements and to allow a low insert conveyor chain velocity.

The conveyor-chain's sets of pusher-pins 74 are spaced closer together than the distance between the respective insert hoppers 16*a–d* (10 inches apart compared to fifteen inches between the hoppers). Such a distance ratio permits the use of relatively low velocity conveyor chains 76 for the insert track while, at the same time, permitting each of the hoppers to dispense an insert in front of each pusher-pin set while maintaining the staggered phase dispensing process explained above. This phasing and spacing relationship, while permitting relatively even power consumption and a moderate chain speed, also aids in avoiding vibrational problems, high wear rates and material handling problems.

As mentioned above, the conveyor chains 76 are continuously moving, thus, it is necessary that the insert hoppers 16*a–d* be programmed to deliver inserts in timed sequences with the sets of pusher pins so that inserts from each of the insert hoppers 16*a–d* are deposited on the insert track 69 in front of the appropriate pusher pin sets. A timing chain (not shown) is provided for this purpose.

As is best illustrated in FIGS. 1, 8 and 9 through 11, pusher arms 78 are mounted for reciprocating movement on the overall in-line inserter frame in the path of the insert track 69, downstream of the insert hoppers 16*a–d*. The structure for reciprocating the pusher arm 78 in slots 80 is not depicted in the drawings and is not described. It is thought that this structure is not sufficiently significant with regard to the invention that it must be described, and that the disclosure is clearer if it is omitted. In any event, end blocks 82 (one shown) simultaneously slide in oppositely located slots 80 and carry with them a pusher-arm shaft 84. The pusher-arm shaft 84 is rotatably mounted in the end blocks 82 and a mechanism (not shown) located at the slots 82 causes positive rotation of the pusher-arm shaft 84 in a sequence to be described below. The pusher-arm 78 is rigidly clamped to the pusher-arm shaft 84 by clamps 86.

The feet 88 of the pusher-arms 78 ride on subtracks 90 (FIG. 8) of the insert track 69 when the pusher-arms 78 are being used to push an insert pile toward envelopes located at the stuffing station 12. However, when the pusher-arms 78 are retracted, back toward the insert hoppers, (FIG. 9) the pusher-arm shaft 84 is rotated in a clockwise direction to raise the pusher-arms 78 away from the insert track 69 so that they can pass over an insert pile 91 that is being pushed along the insert track 69 by the pusher-pins 74. Once the feet 88 pass over the insert pile 91 the pusher-arm shaft 84 is rotated in a counterclockwise direction so that the feet once again, move onto the subtracks 90. Now the mechanism (not shown) for driving the end blocks 82 begin to move the pusher arms 78 toward the stuffing station at an increasing speed until the feet 88 of the pusher-arms 78 overtake the insert pile 91 (FIGS. 10 and 11) and finally shove it into an open, or boxed, envelope at the stuffing station.

Figure 12:
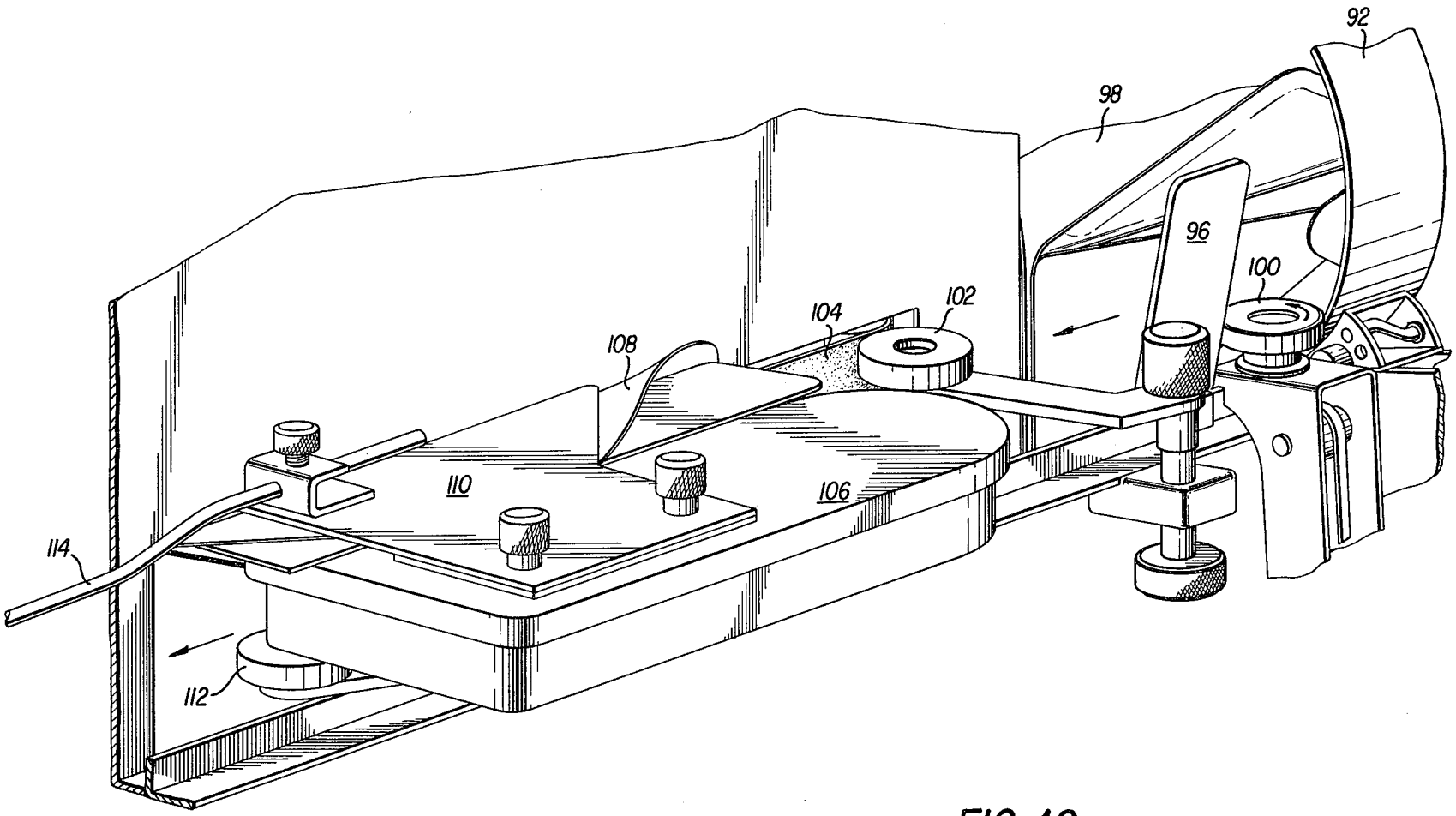
FIG. 12 is an isometric view of apparatus forming a portion of the licking and stacking system of the in-line inserter of FIG. 1.

Turning next to the sealing and stacking system 22, with reference to FIGS. 1, 2, and 12, after an envelope has been stuffed, it is conveyed by the pressure belts 50 and the envelope positioning rollers 48 (FIG. 2) to an envelope guide 92, which causes the bottoms of the envelopes to drop downwardly into a vertical track 94. A special envelope guide 96, (FIGS. 2 and 12) is located at the downstream end of envelopes as they drop into the vertical track 94, and this special guide 96 causes the downstream ends of the envelopes to be closer to a track wall 98 than does the other guide 92. Further, the downstream ends of the envelopes fall onto a first conveying roller 100 (FIG. 12). The first conveying roller 100, by rotating in the direction indicated in FIG. 12, causes the downstream ends of the envelopes to move between the first conveying roller 100 and the wall 98 and also, to be conveyed toward a second conveying roller 102 and a conveying belt 104. The envelopes are conveyed by these elements into a flap moistener 106.

The flap moistener 106 comprises a convoluted guide 108 to guide envelope flaps to positions normal to the main bodies of the envelopes. In these positions, the envelope flaps are passed over a moistener (not shown) located beneath a moistener plate 110. The envelopes are transported beyond the flap moistener 106 by a further conveying roller 112 until they come to a flap closing bar 114. The flap closing bar 114, is bent so that it guides the envelope flaps downwardly and finally urges them into positions approximately adjacent with the main bodies of the envelopes. The envelopes are then passed between pressure rollers (not shown) which press the flaps tightly against the main bodies of the envelopes so that glue on the flaps adheres to the main bodies, thereby sealing the envelopes. The envelopes are then conveyed to an envelope stacking rack 116, (FIG. 1).

Turning now to the operation of the over-all device, envelopes are individually fed from a hopper-held stack 24 (FIG. 2) by means of the pull-foot feeding device 26 and rollers 33 and 34 to gripper jaws 38 at the gripper-jaw chain 36. The gripper-jaws 38 transport and release the envelopes, individually, to the pressure belts 50 and the envelope positioning rollers 48 at the stuffing station 12.

Upon arriving at the stuffing station 12, the envelopes are gripped by the sucker feet 62 which are raised, along with the pressure belts 50, to open the envelopes. At this point, boxing fingers 64 are moved into the envelopes to insure that they are held open.

Figure 10:
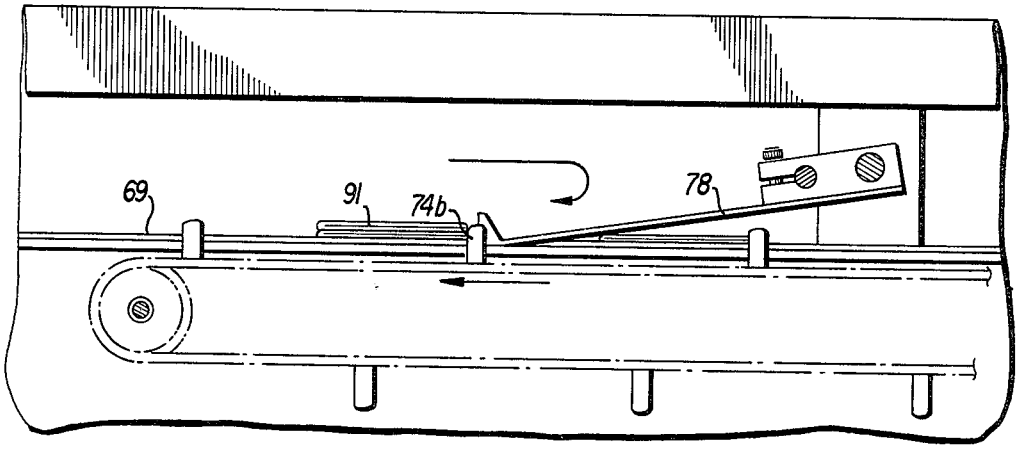
Figure 11:
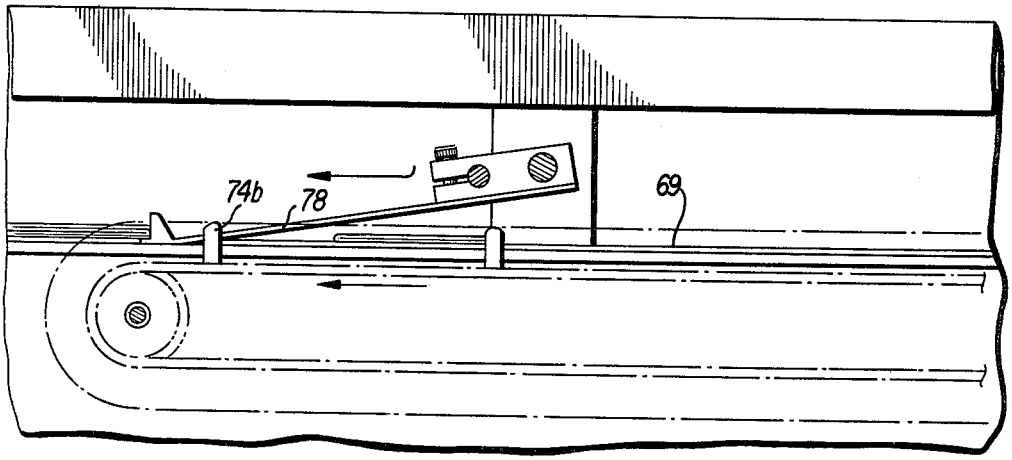

Simultaneously with the above recited steps, inserts from each of the insert hoppers 16*a–d* (FIG. 1) are dropped, one on top of the other, onto the insert track 69 (FIG. 7) in front of respective pusher pin 74 sets. The pusher pin sets push the respective insert piles along the insert track 69, toward the stuffing station. Before each pile reaches the stuffing station 12, it is first passed over and then overtaken by the feet 88 of the pusher-arms 78. This sequence of operations is most clearly depicted in FIGS. 9, 10 and 11. As pusher pins 74*a* are about to drop below the level of the insert track 69 (FIG. 9) the pusher arms 78 are lifted and reciprocated backwardly, over an insert pile 91 which is being transported by pusher pins 74*b*. Substantially maximum backward travel of the pusher arms 78 brings their feet 88 beyond the rear of the insert pile 91. As depicted in FIG. 10, the pusher arms then begin moving forwardly at a somewhat faster speed than the pusher pins 74*b* so as to overtake the pusher pins 74*b* and remove the insert pile 91 just prior to departure of the pusher pins 74*b* from above the surface of the insert track 69. The insert stack 91 is now under the control of the pusher arms 73 and while an envelope is held open at the stuffing station, the pusher arms 78 drive the insert stack 91 into the awaiting open envelope.

Following insert-pile insertion, the pusher arms are raised and withdrawn to pick up the next insert stack and the boxing fingers 64 are extracted from the open envelope. The envelope is released by the sucker feet 62 and the controlling shaft 58 (FIG. 5) is rotated so that the pressure belts 50 again press the stuffed envelope toward the envelope positioning rollers 48. The envelopes are driven, by the envelope positioning rollers 48, bottom edge first, toward the rounded guide 92 (FIGS. 2 and 12) to finally fall into the vertical track 94.

Once in the vertical track, the envelopes are conveyed by the first and second conveying rollers 100 and 102 and the conveying belt 104 (FIG. 12) through the flap moistener 106, the flap closing bar 114 and finally, to the envelope stacking rack 116.

It should be noted that the above described in-line inserter has many advantages over previous inserters. Firstly, the inserts themselves are pulled from hoppers in nearly the same directions as they are subsequently transported. This is in contrast with current right-angle-feed machines and provides smoother and faster operation. Also, the chain transports of this machine are continuous rather than intermittent as are many current machines. Again, this enhances smoother operation.

Similarly, the envelopes travel on a continuous involute path from the envelope hopper to the sealing and stacking system, which enhances compactness and, again, provides smooth operation.

While the invention has been shown and described with reference to preferred embodiments thereof, it will be understood by those skilled in the art, that various alterations in form and detail may be made therein without departing from the spirit and scope of the invention.

The embodiments of the invention in which an exclusive property or privilege is claimed are defined as follows:

1. An inserter assembly comprising:

an envelope handling system including an envelope hopper for holding an envelope stack and an envelope conveying means for conveying envelopes, individually, along an envelope path from said hopper to a stuffing station and from said stuffing station to a stuffed-envelope handling system; and, an insert handling system including at least one insert hopper and an insert conveying means for conveying inserts from said at least one insert hopper to said stuffing station and driving said inserts into respective envelopes positioned at said stuffing station;

wherein a path defined by a point on an envelope moving along said envelope path from said envelope hopper, to said stuffing station, and from said stuffing station to said stuffed-envelope handling system is substantially in a single plane and has a generally polygonal, inwardly wound, shape and wherein said stuffed-envelope handling system includes a conveyor means for receiving stuffed envelopes at the end of said generally polygonal, inwardly wound, path and transporting them away from said single plane of said generally polygonal, inwardly wound path along a new path lateral to said plane of said involute path.

2. An inserter assembly as in claim 1 wherein said envelope conveying means comprises:

a continuously-moving endless conveyor for conveying envelopes from said envelope hopper to said stuffing station; and an envelope dispensing means for dispensing envelopes, one at a time, from said envelope hopper, and accelerating the envelopes to a velocity comparable to the velocity at which the continuously moving endless conveyor conveys for gripping by said continuously moving endless conveyor.

3. An inserter assembly as in claim 2 wherein said dispensing means comprises:

a reciprocating pull foot for reciprocating to a position between an envelope to be dispensed and the remaining stack, and then reciprocating away from the remaining stack pulling the envelope to be dispensed with it; and a roller for reciprocating toward said pull foot when said pull foot is between said envelope and said remaining stack to pinch said envelope between said roller and said pull foot and to roll on said envelope while said pull foot is reciprocating away from said remaining stack.

4. An inserter assembly as in claim 1 wherein said envelope conveying means comprises a continuously moving endless conveyor for conveying envelopes from said hopper to said stuffing station, and wherein is further included stuffing-station apparatus at said stuffing station for stripping said envelopes from said continuously-moving endless conveyor, bringing said envelopes to a stop, and opening said envelopes to receive inserts.

5. An inserter assembly as in claim 4 wherein said stuffing-station apparatus includes:

pressure belts positioned above said envelope path and driving rollers positioned below said envelope path for controlling the positions of said envelopes;

sucker feet for gripping the top sides of said envelopes, said pressure belts and said sucker feet being movable upwardly away from said envelopes so that said sucker feet can pull the top sides of said envelopes upwardly to open said envelopes; and boxing fingers which move into said envelopes after they are opened by said sucker feet to maintain said envelopes in open, or boxed configurations.

6. An inserter assembly as in claim 4 wherein said insert handling system includes an endless, continuously-moving conveyor positioned below said at least one insert hopper for conveying said inserts from said at least one insert hopper to said stuffing station, and a separate stuffing means positioned adjacent said stuffing station for engaging said inserts as they are being conveyed by said endless, continuously-moving conveyor, accelerating said respective inserts above the speed of said continuously-moving endless conveyor and driving said inserts into respective open envelopes at said stuffing station.

7. An inserter assembly as in claim 1 wherein said insert handling system includes an endless, continuously-moving conveyor positioned below said at least one insert hopper for conveying said inserts from said at least one insert hopper to said stuffing station and a separate stuffing means positioned adjacent said stuffing station for engaging said inserts as they are being conveyed by said endless, continuously-moving conveyor, accelerating said respective inserts above the speed of said endless conveyor and driving said inserts into respective open envelopes at said stuffing station.

8. An inserter assembly as in claim 7 wherein said endless, continuously-moving conveyor includes pusher pins which extend upwardly through a stationary plate to engage the following edges of said inserts and drive them in the direction said endless, continuously-moving conveyor conveys.

* * * * *